US008698409B2

(12) United States Patent
Naruo et al.

(10) Patent No.: US 8,698,409 B2
(45) Date of Patent: Apr. 15, 2014

(54) LIGHTING DEVICE AND LIGHTING FIXTURE USING THE SAME

(71) Applicant: Panasonic Corporation, Osaka (JP)

(72) Inventors: Masahiro Naruo, Osaka (JP); Shigeru Ido, Osaka (JP); Kenichi Fukuda, Osaka (JP); Sana Esaki, Osaka (JP)

(73) Assignee: Panasonic Corporation, Osaka (JP)

( * ) Notice: Subject to any disclaimer, the term of this patent is extended or adjusted under 35 U.S.C. 154(b) by 46 days.

(21) Appl. No.: 13/658,661

(22) Filed: Oct. 23, 2012

(65) Prior Publication Data

US 2013/0099694 A1 Apr. 25, 2013

(30) Foreign Application Priority Data

Oct. 24, 2011 (JP) ..... 2011-232816

(51) Int. Cl.
*H05B 37/02* (2006.01)

(52) U.S. Cl.
USPC ..... 315/209 R; 315/224; 315/297

(58) Field of Classification Search
USPC ..... 315/209 R, 224, 291, 294, 297
See application file for complete search history.

(56) References Cited

U.S. PATENT DOCUMENTS

| | | | | |
|---|---|---|---|---|
| 7,071,762 | B2 | 7/2006 | Xu et al. | |
| 2003/0085749 | A1 | 5/2003 | Xu et al. | |
| 2006/0226794 | A1 * | 10/2006 | Takahashi et al. | 315/308 |
| 2009/0323033 | A1 * | 12/2009 | Konishi et al. | 353/85 |
| 2011/0089846 | A1 * | 4/2011 | Ido | 315/209 R |

FOREIGN PATENT DOCUMENTS

JP 2006-511078 A 3/2006

* cited by examiner

*Primary Examiner* — Jason M Crawford
(74) *Attorney, Agent, or Firm* — Renner, Otto, Boisselle & Sklar, LLP

(57) ABSTRACT

The lighting device in accordance with the present invention includes: a switching regulator including a switching element and an inductor and configured to supply a direct current to a DC light source; a control circuit unit for controlling the switching element in accordance with a dimming signal for determining an on period in which the DC light source is kept turned on and an off period in which the DC light source is kept turned off to adjust luminance of the DC light source; a current detection unit configured to output a detection value indicative of a current flowing through the inductor; and a superimposing circuit unit. The circuit control unit, in the on period, turns off the switching element when an input value received via the input terminal for receiving the detection value exceeds a first threshold, and turns on the switching element when the input value falls below a second threshold, and keeps turning off the switching element in the off period. The superimposing circuit unit is configured to keep the input value not less than the second threshold in the off period.

12 Claims, 9 Drawing Sheets

LIGHTING DEVICE AND LIGHTING FIXTURE USING THE SAME

TECHNICAL FIELD

The present invention relates to a lighting device and a lighting fixture using the same.

BACKGROUND ART

In the past, there has been proposed a lighting device which includes a control switch for supplying a constant current to an LED lighting module and supplies a dual signal defined by a low-frequency burst signal constituted by high-frequency pulses to the control switch (see document 1 [JP 2006-511078 A]).

As shown in FIG. 8, such a lighting device includes a series circuit of a diode D10 connected between opposite ends of a DC power source 100 and a control switch 101 illustrated as a MOSFET.

Further, an inductor L10 and an LED lighting module 102 are connected between opposite ends of the diode D10.

A controller 103 generates a dual PWM switching signal supplied to a control input unit of the control switch 101 via an amplifier 104. This dual PWM switching signal is substantially identical to a combination of a low-frequency pulse burst signal (i.e., a low-frequency PWM switching signal component) and a high-frequency PWM switching signal component superimposed on the low-frequency pulse burst signal.

The controller 103 includes a current mode pulse width modulator 105. The current mode pulse width modulator 105 receives an LED current reference signal from a current source 106, a detection current, and a high-frequency saw-tooth wave signal.

The current mode pulse width modulator 105 generates the high-frequency PWM switching signal component supplied to one of input parts of an AND gate 107, and the AND gate 107 receives the low-frequency PWM switching signal component at the other of the input parts. An output from the AND gate 107 is supplied to a gate of the control switch 101 through the amplifier 104.

As mentioned in the above, this lighting device can change an average current flowing through the LED lighting module 102 by means of adjusting the low frequency component of the dual PWM switching signal in order to vary intensity of light emitted from the LED lighting module 102, The dual PWM switching signal supplied to the control input unit of the control switch 101 is a logical multiplication of the low-frequency PWM signal and the high-frequency driving signal. Therefore, when the PWM signal falls in the on period of the control switch 101, the driving signal of the control switch 101 is switched to a low level. Thus, the on period of the control switch 101 has a length varied in accordance with the change in the on-duty level (duty ratio) of the PWM signal. Such a variation of the length of the on period causes a change in a current (load current) flowing through the LED lighting module 102, that is, a light output of the LED lighting module 102. Therefore, the prior device changes the duty ratio of the PWM signal to perform the burst dimming control of the LED lighting module 102.

Further, as shown in FIG. 9, there has been proposed a lighting device 1A including a control circuit 3 constituted by a general-purpose PFC (Power Factor Correction) integrated circuit. The control circuit unit 3 is designed to control a switching element Q1 included in a lighting circuit unit 2 for supplying a current to a light source unit 10. For example, such a general-purpose PFC integrated circuit is "MC33262" (available from ON Semiconductor) and "L6562" (available from ST Microelectronics). The following explanation referring to FIG. 9 is made to the lighting device 1A.

This lighting device 1A includes mainly the lighting circuit unit 2, the control circuit unit 3, and current detection units 41 and 42. The switching regulator 2 is configured to decrease a DC voltage outputted from a DC power source E1 and supply a current I1 to the light source unit 10. The control circuit unit 3 is configured to control an output of the switching regulator 2. The current detection units 41 and 42 are configured to measure the current I1.

In the switching regulator 2, a series circuit of the light source unit 10, an inductor L1, the switching element Q1, and a resistor R1 is interposed between opposite ends of the DC power source E1.

Further, there is a diode D1 which is connected in parallel with a series circuit of the light source unit 10 and the inductor L1. The diode D1 is used for supplying energy stored in the inductor L1 (a regeneration current from the inductor L1) to the light source unit 10 in the off period Toff of the switching element Q1 constituted by an n-channel MOSFET.

The switching regulator 2 has the above configuration acting as a step-down chopper circuit. The switching regulator 2 obtains an input from the DC power source E1. The switching regulator 2 supplies the current I1 to the light source unit 10 in response to an on-off operation of the switching element Q1, thereby lighting the light source unit 10.

The light source unit 10 is constituted by plural (three in the illustrated instance) light emitting diodes 10*a* connected in series with each other. Besides, the number of the light emitting diodes 10*a* constituting the light source unit 10 is not limited to two or more. The light source unit 10 may be constituted by the single light emitting diode 10*a*. The light emitting diode 10*a* is used as a light emitting element constituting the light source unit 10. The light source unit 10 may be constituted by other kinds of light emitting elements (e.g., organic EL elements).

The current detection unit 41 is constituted by the resistor R1 connected in series with the switching element Q1. The current detection element 41 outputs a voltage across the resistor R1 to the control circuit unit 3 as a detection value (detection voltage Va) of the current I1 flowing in the on period of the switching element Q1.

Further, the current detection unit 42 is constituted by a secondary winding n2 of the inductor L1. The current detection element 42 outputs a voltage induced in the secondary winding n2 to the control circuit unit 3 as a detection value (detection voltage Vzcd) of the current I1 flowing in the on period of the switching element Q1.

The control circuit unit 3 is constituted by a driving circuit unit 31, a flip-flop 32, a comparator 33, a zero-current detection circuit 34, a starter 35, and an OR circuit 36. The control circuit unit 3 turns on and off the switching element Q1 to control the current I1 based on the detection values of the current detection units 41 and 42, thereby operating the lighting device 1 at a critical mode.

The comparator 33 has a non-inverting input terminal receiving the reference voltage Vref1, and an inverting input terminal connected to the high voltage side of the resistor R1 via the resistor R2 to receive the detection voltage Va of the current detection unit 41. Further, the comparator 33 has an output terminal connected to an R terminal of the flip-flop 32.

Additionally, when the current I1 flowing through the resistor R1 is increased and then the detection voltage Va exceeds the reference voltage Vref1 in the on period of the switching element Q1, an output signal (reset signal) of the comparator 33 is changed from a low level to a high level.

The zero-current detection circuit 34 has an input terminal connected to one end of the secondary winding n2 of the inductor L1 to receive the detection voltage Vzcd of the current detection unit 42 at the input terminal. When the current (regeneration current) I1 flowing through the inductor L1 is decreased and then the detection voltage Vzcd falls below the threshold voltage Vth in the off period of the switching element Q1, the zero-current detection circuit 34 outputs a set signal constituted by a pulse wave to the OR circuit 36.

The flip-flop 32 is an RS flip-flop, and has an S terminal connected to an output terminal of the OR circuit 36, the R terminal connected to the output of the comparator 36, and a Q terminal connected to the driving circuit unit 31. The driving circuit unit 31 generates the driving signal S1 for turning on and off the switching element Q1 based on the output signal of the flip-flop 32.

Additionally, the OR circuit 36 has one input terminal connected to the output terminal of the zero-current detection circuit 34 and the other input terminal connected to an output terminal of the starter 35.

The starter 35 monitors an output of the flip-flop 32. When the output signal of the flip-flop 32 is kept at a low level for a predetermined period, the starter 35 starts to periodically output a set signal constituted by a pulse wave to the OR circuit 36. Therefore, when the set signal is outputted from any one of the zero-current detection circuit 34 and the starter 35, the OR circuit 36 outputs a set signal to the flip-flop 32.

Upon detecting an edge of the set signal inputted into the S terminal, the flip-flop 32 is changed to a set state and the flip-flop 32 switches a signal level of the output signal to a high level. Further, when a reset signal having a high level is inputted into the R terminal, the flip-flop 32 is changed to a reset state and the flip-flop 32 keeps the output signal at the low level. While the flip-flop 32 has the reset state, the flip-flop 32 keeps the output signal at the low level irrespective of input of the set signal.

When the output signal of the flip-flop 32 has the high level, the driving circuit unit 31 changes a signal level of the driving signal S1 outputted to the switching element Q1 to a high level so as to turn on the switching element Q1. When the output signal of the flip-flop 32 has the low level, the driving circuit unit 31 changes the signal level of the driving signal S1 to a low level so as to turn off the switching element Q1.

In brief, upon judging that the current I1 is increased and the detection voltage Va of the current detection unit 41 exceeds the reference voltage Vref1 while the switching element Q1 is turned on, the control circuit unit 3 changes the state of the flip-flop 32 to the reset state, and turns off the switching element Q1.

In contrast, upon judging that the current I1 is decreased and the detection voltage Vzcd of the current detection unit 42 falls below the threshold voltage Vth while the switching element Q1 is turned off, the control circuit unit 3 changes the state of the flip-flop 32 to the set state, and turns on the switching element Q1.

The control circuit unit 3 performs such an on-off operation of the switching element Q1 to control the current I1.

Further, the control circuit unit 3 performs the on-off operation of the switching element Q1 intermittently in accordance with a dimming signal S2 outputted from a dimming signal generation unit 5, thereby performing the burst dimming control of the light source unit 10.

The dimming signal S2 is constituted by a low-frequency PWM signal defined as a binary signal having a high level (first state) and a low level (second state).

The control circuit unit 3 performs the on-off operation of the switching element Q1 when the dimming signal S2 has the high level, and does not perform the on-off operation of the switching element Q1 when the dimming signal has the low level.

To perform the aforementioned dimming control, the lighting device 1A includes a dimming control unit 6.

The dimming control unit 6 is constituted by a resistor R3, a switching element Q2, and a control power source E2. The control power source E2, the switching element Q2, and the resistors R1 to R3 constitute a series circuit.

Further, the switching element Q2 is turned on and off in accordance with the signal level of the dimming signal S2 for superimposing a predetermined voltage on the detection voltage Va. In other words, the detection voltage Va is increased by the predetermined voltage.

Interposed between the switching element Q2 and the dimming signal generation unit 5 is an inverting element 51. Thus, a signal (hereinafter referred to as "dimming signal S2*a*") obtained by inverting the dimming signal S2 is inputted into the switching element Q2.

When the dimming signal S2*a* has the high level (the dimming signal S2 has the low level), the switching element Q2 is turned on. When the dimming signal S2*a* has the low level (the dimming signal S2 has the high level), the switching element Q2 is turned off.

The control power source E2 is configured to outputs a control voltage VDD. When the switching element Q2 is turned on, a current flows from the control power source E2 to the resistors R1 to R3 via the switching element Q2. As a result, the predetermined voltage is superimposed on (added to) the detection voltage Va applied to the inverting input terminal of the comparator 33. It is assumed that the resistors R2 and R3 have resistances r2 and r3, respectively. The resistances r2 and r3 are selected to satisfy a relation of $r2/(r2+r3) > Vref1/VDD$ while the switching element Q2 is turned on. Thus, the increased detection voltage Va (the sum of the original detection voltage Va and the predetermined voltage) exceeds the reference voltage Vref1.

Consequently, the reset signal outputted from the comparator 33 has the high level, and the flip-flop 32 keeps having the reset state. In brief, when the switching element Q2 is turned on, the switching element Q1 is kept turned off and the light source unit 10 is switched to an extinction state.

Additionally, when the switching element Q2 is turned off, a path of an output current of the control power source E2 is broken. The voltage is not superimposed on the detection voltage Va. As a result, the control circuit unit 3 performs the aforementioned on-off operation of the switching element Q1. In brief, when the switching element Q2 is turned off, the on-off operation of the switching element Q1 is executed and the light source unit 10 is switched to a lighting state.

As described in the above, the intermittent control of the on-off operation of the switching element Q1 is performed in accordance with the on-duty level (duty ratio) of the dimming signal S2. Therefore, the burst dimming control of dimming the light source unit 10 can be implemented.

The following explanation referring to FIG. 10 (*a*) to (*d*) is made to a sequence of operations of the lighting device 1A.

When the sequence proceeds to an on period Ton in which the dimming signal S2 has the high level, the set signal for activation is inputted into the OR circuit 36 from the starter 35, and the other set signal is inputted into the S terminal of the flip-flop 32 from the OR circuit 36. As a result, the flip-flop 32 is switched to the set state, and the output signal from the flip-flop 32 is changed to the high level. Consequently, the driving signal S1 of the driving circuit unit 31 is switched to the high level, and the switching element Q1 is switched from the off state to the on state. Thus, a current flows from the DC power source E1 through the light source unit 10, the inductor L1, the switching element Q1, and the resistor R1 to the DC power source E1 in this order. Consequently, the current I1 is increased (see FIG. 10 (*d*)).

The increase in the current I1 causes an increase in the voltage across the resistor R1, that is, the detection voltage Va of the current detection unit 41 (see FIG. 10 (*c*)). In this situation, since the switching element Q2 has the off state, no voltage is superimposed on (added to) the detection voltage Va.

Subsequently, when the detection voltage Va reaches the reference voltage Vref1, the output of the comparator 33 is inverted, and then the reset signal having the high level is inputted into the R terminal of the flip-flop 32. Consequently, the flip-flop 32 is switched to the reset state, and the output signal is switched from the high level to the low level. Further, the driving signal S1 of the driving circuit unit 31 is also switched from the high level to the love level, and then the switching element Q1 is switched from the on state to the off state (see FIG. 10 (*c*)).

When the switching element Q1 is switched to the off state, energy stored in the inductor L1 causes a regeneration current flowing through a closed path of the diode D1, the light source unit 10, and the inductor L1. Specifically, such a regeneration current is outputted from the inductor L1 and passes through the diode D1 and thereafter the light source unit 10 and returns to the inductor L1.

The current I1, that is, the current flowing through the inductor L1 is gradually decreased and finally becomes zero (see FIG. 10 (*d*)). Besides, a broken line in FIG. 10 (*d*) shows a peak value Ith of the current I1.

When the current flowing through the inductor L1 reaches zero, the inductor L1 causes a reverse current, and then electric charges stored in the switching element Q1 is discharged via a parasitic capacitance of a device (e.g., the diode D1). As a result, a drain-source voltage of the switching element Q1 is decreased. Consequently, a reverse of a voltage applied across the inductor L1 occurs. The zero-current detection circuit 34 detects the reverse of the voltage on the basis of a voltage induced in the secondary winding n2.

Upon detecting the reverse of the voltage of the inductor L1 (an event where the detection voltage Vzcd falls below the threshold voltage Vth), that is, a zero crossing of the current flowing through the inductor L1, the zero-current detection circuit 34 outputs the set signal to the OR circuit 36.

Thus, the OR circuit 36 outputs the set signal to the S terminal of the flip-flop 32. The flip-flop 32 is switched to the set state and the output signal from the flip-flop 32 is switched from the low level to the high level. Further, the driving signal S1 of the driving circuit unit 31 is also switched from the low level to the high level, and then the switching element Q1 is changed from the off state to the on state (see FIG. 10 (*c*)).

With performing the on-off operation of the switching element Q1 defined as a repetition of a series of operations (turning on and off of the switching element Q1), the control circuit unit 3 operates the switching element Q1 at a critical mode. Each lighting diode 10*a* of the light source unit 10 emits light while the current I1 flows through the light source unit 10.

Thereafter, when the sequence proceeds to the on period Toff in which the dimming signal S2 has the low level, the switching element Q2 is switched from the off state to the on state, and the predetermined voltage is superimposed on the detection voltage Va. As a result, the resultant (increased) detection voltage Va exceeds the reference voltage Vref1. Consequently, the reset signal which is inputted into the R terminal of the flip-flop 32 is kept at the high level, and the flip-flop 32 is kept in the reset state. Thus, the output signal from the flip-flop 32 is switched to the low level. Therefore, the driving signal S1 of the driving circuit unit 31 is also switched to the low level, and the switching element Q1 is kept turned on.

After the signal level of the dimming signal S2 is inverted again and the sequence proceeds to the on period Ton, the current I1 does not flow through until the starter 35 outputs the set signal. Thus, each light emitting diode 10*a* of the light source unit 10 is turned off.

To adjust the luminance of the light source unit 10, the intermittent control of the on-off operation of the switching element Q1 which repeats the aforementioned sequence of the operations based on the dimming signal S2 defined as the low-frequency PWM signal, that is, the burst dimming control, is performed. Therefore, with changing the on-duty level (duty ratio) of the dimming signal S2, it is possible to change the proportion of lighting time and extinction time to whole time. Thus, the dimming control of the light source unit 10 can be achieved.

Note that the general-purpose integrated circuit (IC) used for constituting the control circuit unit 3 includes the starter 35. The starter 35 is configured to output the set signal after a lapse of a predetermined period (hereinafter referred to as "starting period Tstr") from the time at which the on-off operation is terminated in the off period Toff. Therefore, when the aforementioned burst dimming control is performed by use of such a general-purpose integrated circuit, and when the off period Toff is selected to be shorter than the starting period Tstr, the duty ratio unavailable for the dimming control is likely to exist.

FIG. 11 (*a*) to (*c*) shows an instance where the off period Toff in which the on-off operation of the switching element Q1 is terminated is longer than the starting period Tstr of the starter 35. In this instance, the starter 35 is activated in the off period Toff and outputs the set signal periodically. Therefore, when the sequence proceeds to the on period Ton, the reset state of the flip-flop 32 is canceled, and the starter 35 outputs the set signal. Consequently, the on-off operation of the switching element Q1 is restarted immediately.

FIG. 12 (*a*) to (*c*) shows an instance where the off period Toff is shorter than the starting period Tstr. In this instance, even when the sequence proceeds from the off period Toff to the period Ton, the starter 35 does not output the set signal until the starting period Tstr elapses. After a lapse of the starting period Tstr, the starter 35 outputs the set signal and then the on-off operation of the switching element Q1 is restarted.

In brief, when the off period Toff is shorter than the starting period Tstr, the following problem will occur. That is, it is impossible to restart the on-off operation until the starting period Tstr elapses. The starting period Tstr depends on the general-purpose IC used for constructing the control circuit unit 3. For example, the L6562A available from ST Microelectronics has the starting period Tstr of typically 190 μs.

To perform the burst dimming control of the light source unit 10 at the relatively high dimming level, it is necessary to select the relatively high on-duty level (duty ratio). However, in a range of the duty ratio in which the off period Toff is shorter than the starting period Tstr, the dimming level is not changed. Besides, when the on duty level has 100%, the dimming signal S2 always has the high level and the starter 35 does not operate. Therefore, the aforementioned problem does not occur.

For example, the control circuit unit 3 is constituted by use of the L6562A available from ST Microelectronics having the starting period Tstr of 190 μs, and the dimming signal S2 has a frequency of 1 kHz. In this instance, in a range in which the on-duty level of the dimming signal S2 is greater than about 80% and is less than 100%, the dimming level of the light source unit 10 is not changed.

For example, to avoid the above problem, parameters of the lighting device can be selected such that the light output corresponding to the dimming signal S2 having the on-duty level not greater than 80% is increased up to the light output of 100% without changing the on-duty level. However, this solution causes an increase in the peak current. Therefore, there will occur another problem that an energy loss is increased.

SUMMARY OF INVENTION

In view of the above insufficiency, the present invention has aimed to propose the lighting device and the lighting fixture using the same which are capable of extending a dimming range of burst dimming control.

The lighting device of the first embodiment in accordance with the present invention includes a switching regulator, a control circuit unit, a current detection unit, and a superimposing circuit unit. The switching regulator includes a switching element and an inductor, and is configured to supply a direct current to a DC light source. The control circuit unit is used for controlling the switching element in accordance with a dimming signal to adjust luminance of the DC light source. The current detection unit is configured to output a detection value indicative of a current flowing through the inductor. The dimming signal is defined as a signal for determining an on period in which the DC light source is kept turned on and an off period in which the DC light source is kept turned off. The circuit control unit includes an input terminal used for receiving the detection value. The circuit control unit is configured to, in the on period, turn off the switching element when an input value received via the input terminal exceeds a first threshold, and turn on the switching element when the input value falls below a second threshold. The circuit control unit is configured to keep turning off the switching element in the off period. The superimposing circuit unit is configured to keep the input value not less than the second threshold in the off period.

In the lighting device of the second aspect in accordance with the present invention, in addition to the first aspect, the superimposing circuit unit is configured to provide the detection value to the input terminal of the control circuit unit in the on period.

In the lighting device of the third aspect in accordance with the present invention, in addition to the first or second aspect, the current detection unit is configured to output a detection signal having a signal value corresponding to the detection value. The superimposing circuit unit is configured to superimpose a synchronization signal synchronized with the dimming signal on the detection signal such that the input value is kept not less than the second threshold in the off period.

In the lighting device of the fourth aspect in accordance with the present invention, in addition to any one of the first to third aspects, the lighting device further comprises a dimming control circuit. The current detection unit is configured to output, as the detection value, a first detection value corresponding to a current flowing through the inductor while the switching element is turned on, and a second detection value corresponding to a current flowing through the inductor while the switching element is turned off. The control circuit unit includes, as the input terminal, a first input terminal used for receiving the first detection value and a second input terminal used for receiving the second detection value. The circuit control unit is configured to turn off the switching element when a first input value received via the first input terminal exceeds the first threshold, and to turn on the switching element when a second input value received via the second input terminal falls below the second threshold. The dimming control circuit is configured to keep the first input value greater than the first threshold in the off period. The superimposing circuit unit is configured to keep the second input value not less than the second threshold in the off period.

In the lighting device of the fifth aspect in accordance with the present invention, in addition to the fourth aspect, the dimming control unit is configured to provide the first detection value to the first input terminal of the control circuit unit in the on period. The superimposing circuit unit is configured to provide the second detection value to the second input terminal of the control circuit unit in the on period.

In the lighting device of the sixth aspect in accordance with the present invention, in addition to the fourth or fifth aspect, the current detection unit is provided as a set of a first current detection unit for obtaining the first detection value and a second current detection unit for obtaining the second detection value. The first current detection unit is constituted by a resistor connected in series with the switching element. The second current detection unit is constituted by a second inductor magnetically connected to the inductor.

In the lighting device of the seventh aspect in accordance with the present invention, in addition to any one of the first to sixth aspects, the dimming signal has a second signal value. The dimming signal has a first period in which the second signal value exceeds a predetermined value and a second period in which the second signal falls below the predetermined value. One of the first period and the second period defines the on period and the other of the first period and the second period defines the off period.

In the lighting device of the eighth aspect in accordance with the present invention, in addition to any one of the first to seventh aspects, the switching regulator is configured to store energy from a power source in the inductor while the switching element is turned on, and supply energy stored in the inductor to the DC light source while the switching element is turned off.

In the lighting device of the ninth aspect in accordance with the present invention, in addition to the eighth aspect, the switching regulator is constituted by a step-down chopper circuit.

In the lighting device of the tenth aspect in accordance with the present invention, in addition to any one of the first to ninth aspects, the lighting device further comprises a DC power generation unit. The switching regulator is configured to supply a direct current to the DC light source by use of DC power from the DC power generation unit. The DC power generation unit is constituted by an AC/DC converter or a DC/DC converter.

The lighting fixture of the eleventh aspect in accordance with the present invention includes a lighting device defined by any one of the first to tenth aspects, and a fixture body configured to accommodate the lighting device.

DESCRIPTION OF EMBODIMENTS

First Embodiment

Figure 1:
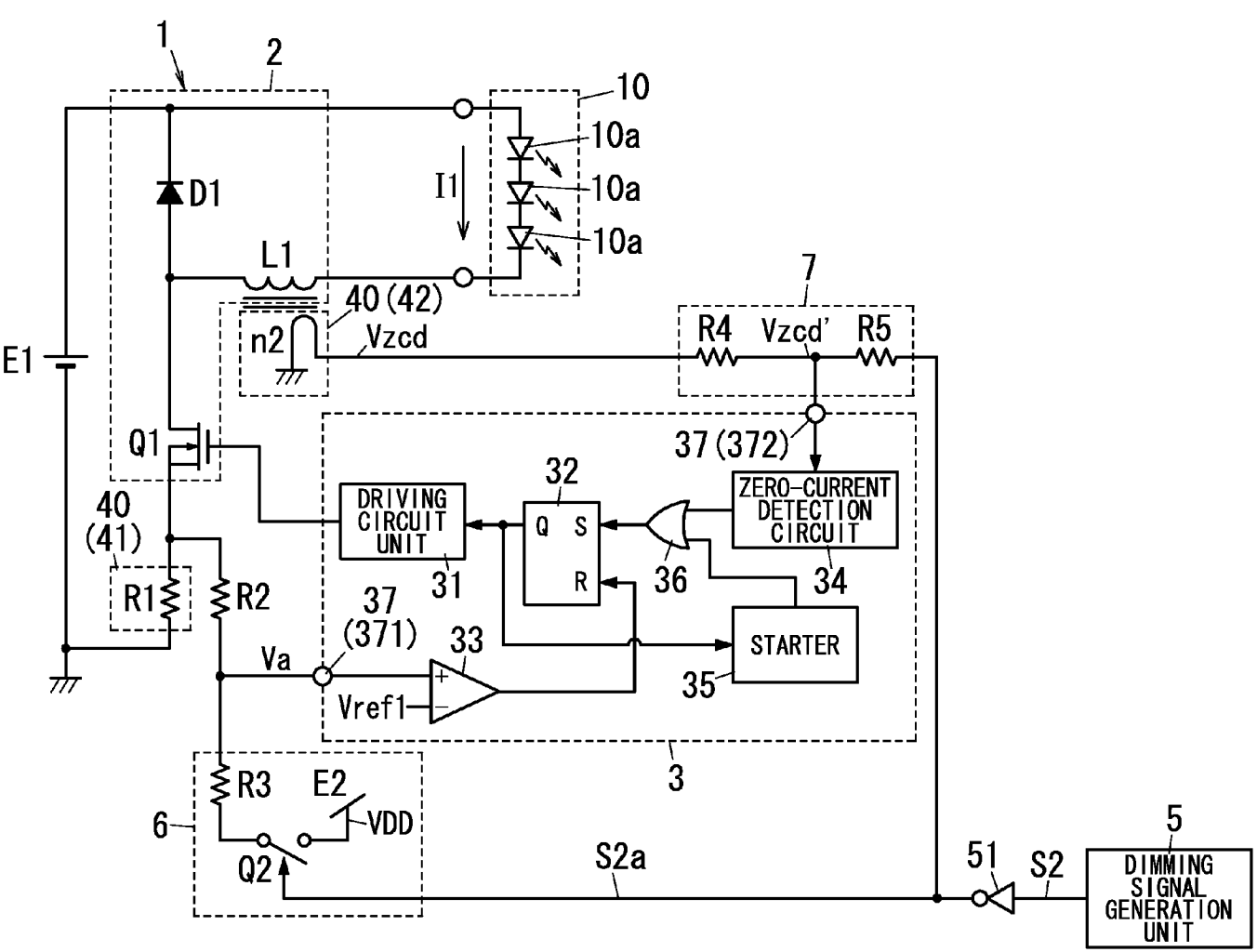
FIG. 1 is a circuit configuration diagram illustrating the lighting device 1 of the first embodiment in accordance with the present invention.
Figure 9:
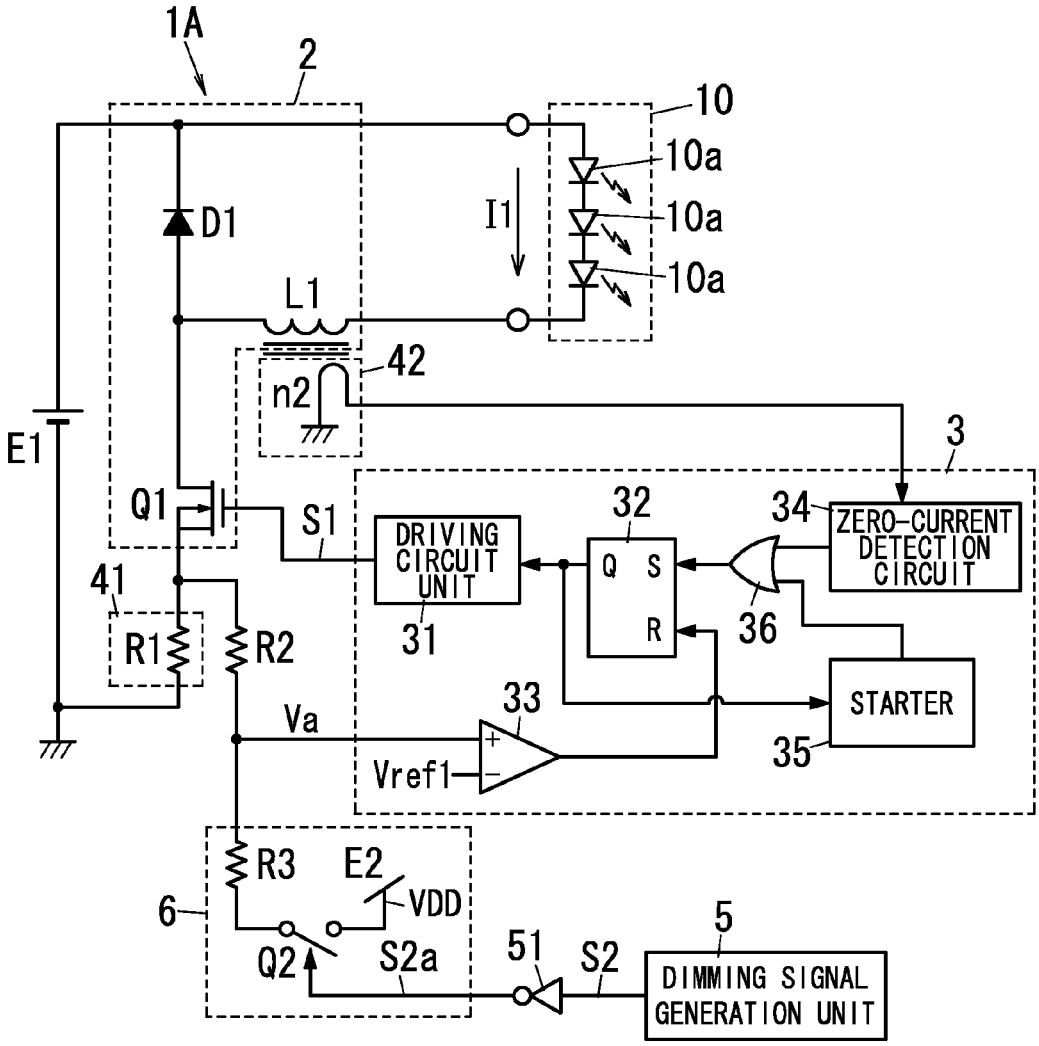
FIG. 9 is a circuit configuration diagram illustrating a prior lighting device 1A.
Figure 10:
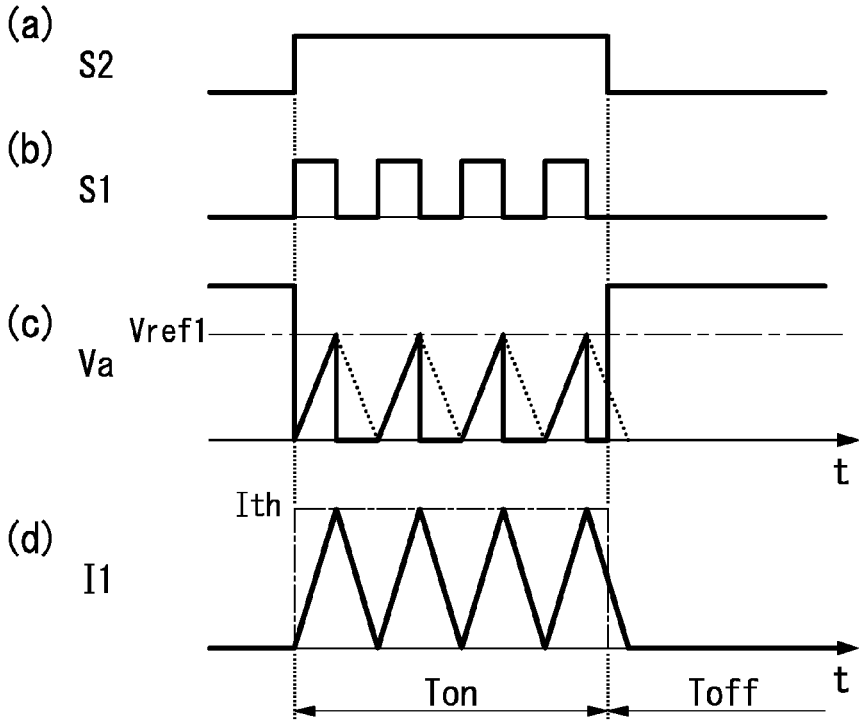
FIG. 10 shows a timing chart (a) illustrating the dimming signal S2, a timing chart (b) illustrating the driving signal S1, a timing chart (c) illustrating the detection voltage Va, and a timing chart (d) illustrating the current I1.
Figure 11:
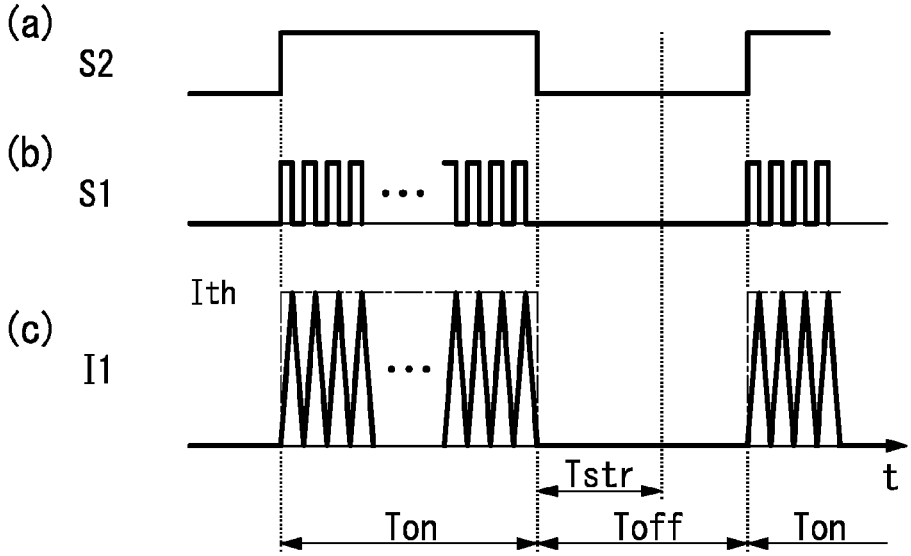
FIG. 11 shows a timing chart (a) illustrating the dimming signal S2, a timing chart (b) illustrating the driving signal S1, and a timing chart (c) illustrating the current I1.
Figure 12:
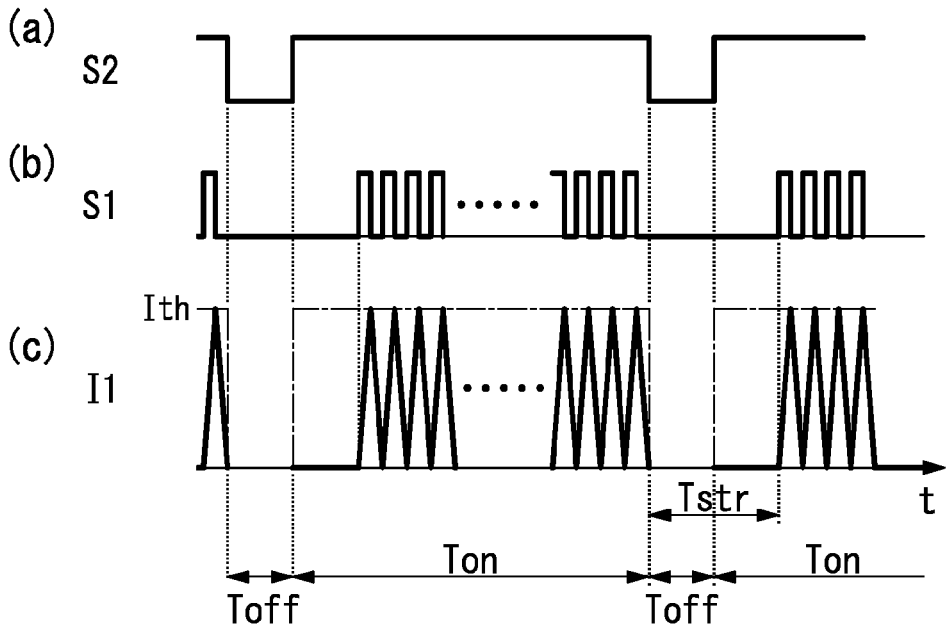
FIG. 12 shows a timing chart (a) illustrating the dimming signal S2, a timing chart (b) illustrating the driving signal S1, and a timing chart (c) illustrating the current I1.

FIG. 1 shows a circuit configuration diagram of the lighting device 1 of the present embodiment. The lighting device 1 of the present embodiment includes mainly a lighting circuit unit 2, a control circuit unit 3, and current detection units 41 and 42. The switching regulator 2 is configured to decrease a DC voltage outputted from a DC power source E1 and supply a current I1 to a light source unit 10. The control circuit unit 3 is configured to control an output of the switching regulator 2. The current detection units 41 and 42 are configured to measure the current I1. Besides, the same components of the present embodiment as a prior lighting device 1A explained with reference to FIG. 9 are designated by the same reference numerals, and no explanations thereof are deemed necessary.

The following explanation is made to a configuration of the lighting device 1 of the present embodiment.

The lighting device 1 of the present embodiment includes a superimposing circuit unit (superimposing means) 7 in addition to the prior lighting device 1A. The superimposing circuit unit 7 is configured to superimpose a synchronization signal synchronized with a signal state of a dimming signal S2 on a detection value of a current detection unit 42. In brief, a voltage signal obtained by dividing a dimming signal S2*a* by resistors R4 and R5 is corresponding to the synchronization signal.

In the present embodiment, the superimposing circuit unit 7 superimposes the dimming signal S2*a* having an inverted signal level of the dimming signal S2 on a detection voltage Vzcd.

The superimposing circuit unit 7 is constituted by a series circuit of the resistors R4 and R5. The superimposing circuit unit 7 is interposed between an inverting element 51 and a secondary winding n2 of an inductor L1.

There is a zero-current detection circuit 34 connected to a connection point of the resistors R4 and R5, and the zero-current detection circuit 34 receives the detection voltage Vzcd via the resistor R4.

The superimposing circuit unit 7 divides the signal level of the dimming signal S2*a* by the resistors R4 and R5 and superimposes the resultant signal level on the detection voltage Vzcd.

Besides, when the dimming signal S2*a* has a high level, a voltage superimposed on the detection voltage Vzcd is selected to be higher than a threshold voltage Vth (second threshold). When the dimming signal S2*a* has a low level, a voltage superimposed on the detection voltage Vzcd is selected to be 0 V (less than the threshold voltage Vth).

The following is a detailed explanation of the lighting device 1 of the present embodiment.

As shown in FIG. 1, the lighting device 1 of the present embodiment includes the switching regulator (lighting circuit unit) 2, the control circuit unit 3, a current detection unit 40, the inverting element 51, a dimming control unit 6, and the superimposing circuit unit (superimposing means) 7.

The lighting circuit unit 2 includes a switching element Q1 and the inductor L1. The lighting circuit unit 2 is configured to supply a direct current to a DC light source (light source unit) 10. The lighting circuit unit 2 is configured to store energy from a power source (DC power source) E1 in the inductor L1 while the switching element Q1 is turned on, and supply energy stored in the inductor L1 to the DC light source (light source unit) 10 while the switching element Q1 is turned off. In the present embodiment, the lighting circuit unit 2 is constituted by a step-down chopper circuit.

The current detection unit (load current detection unit) 40 is configured to output a detection value indicative of a current (load current I1) flowing through the inductor L1. The current detection unit 40 is configured to output a detection signal having a signal value corresponding to the detection value. Besides, in the present embodiment, the detection signal is a voltage signal having a voltage value corresponding to the detection value. Alternatively, the detection signal may be a current signal having a current value corresponding to the detection value or a digital signal indicative of the detection value.

Especially, the lighting device 1 of the present embodiment includes a first current detection unit 41 and the second current detection unit 42 as the current detection unit 40.

The first current detection unit 41 is configured to output a first detection value corresponding to a current flowing through the inductor L1 while the switching element Q1 is turned on. The first current detection unit 41 is constituted by a resistor R1 connected in series with the switching element Q1. The resistor R1 is interposed between a low-voltage terminal of the DC power source E1 and the switching element Q1. The first current detection unit 41 is configured to output a first detection signal having a signal value corresponding to the first detection value.

The second current detection unit 42 is configured to output a second detection value corresponding to a current flowing through the inductor L1 while the switching element Q1 is turned off. The second current detection unit 42 is constituted by the second inductor (secondary winging) n2 magnetically coupled with the inductor L1. The second current detection unit 42 is configured to output a second detection signal having a signal value corresponding to the second detection value.

As mentioned in the above, in the present embodiment, the current detection unit 40 is configured to output, as the detection value, the first detection value and the second detection value.

The control circuit unit 3 is used for controlling the switching element Q1 in accordance with the dimming signal S2 to adjust luminance of the DC light source (light source unit) 10.

Figure 2:
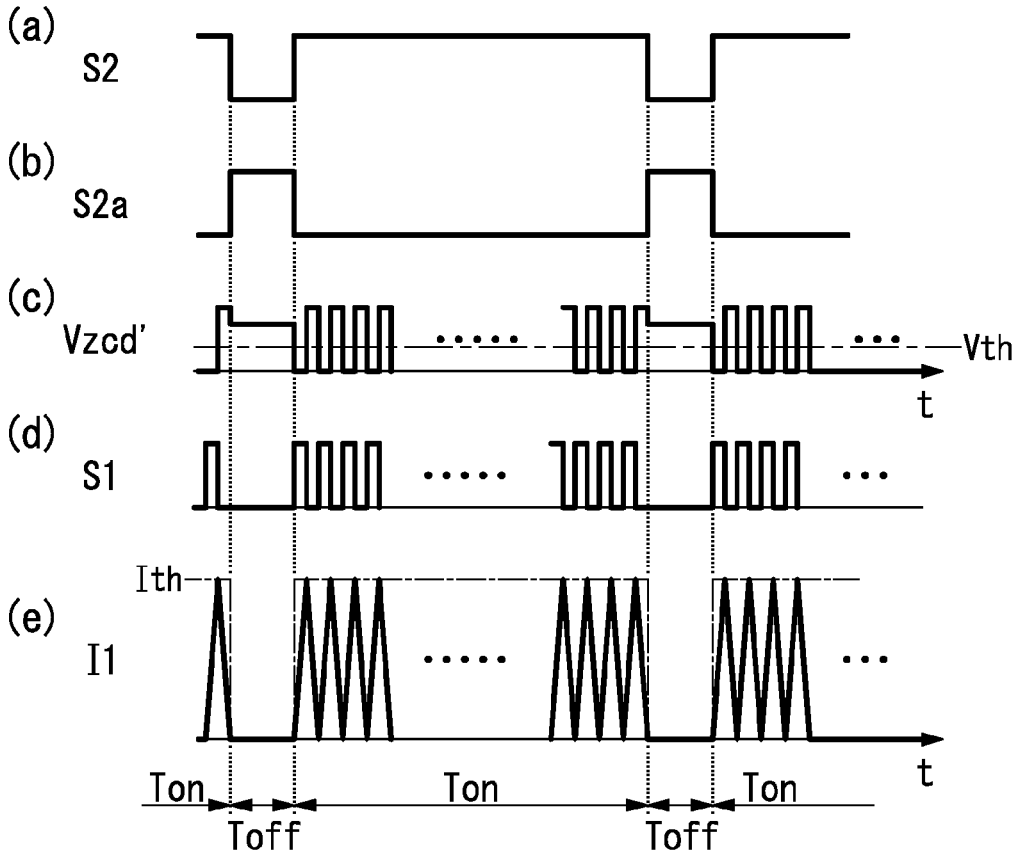
FIG. 2 shows a timing chart (a) illustrating the dimming signal S2, a timing chart (b) illustrating the dimming signal S2*a*, a timing chart (c) illustrating the detection voltage Vzcd', a timing chart (d) illustrating the driving signal S1, and a timing chart (e) illustrating the current I1.

The dimming signal S2 is defined as a signal for determining an on period Ton in which the DC light source 10 is kept turned on and an off period Toff in which the DC light source 10 is kept turned off. For example, the dimming signal S2 has a signal value (second signal value). As shown in FIG. 2 (*a*), the dimming signal S2 has a first period (high-level period) in which the second signal value exceeds a predetermined value and a second period (low-level signal) in which the second signal falls below the predetermined value. One of the first period and the second period defines the on period Ton and the other of the first period and the second period defines the off period Toff. In the present embodiment, the first period (high-level period) defines the on period Ton and the second period (low-level period) defines the off period Toff.

The control circuit unit 3 includes a driving circuit unit 31, a flip-flop 32, a comparator 33, the zero-current detection circuit 34, a starter 35, and an OR circuit 36. Further, the control circuit unit 3 includes an input terminal 37 designed for receiving the detection value.

The circuit control unit 3 is configured to, in the on period Ton, turn off the switching element Q1 when an input value (in the present embodiment, a voltage applied to the input terminal 37) received via the input terminal 37 exceeds a first threshold, and turn on the switching element Q1 when the input value falls below a second threshold. In addition, the circuit control unit 3 is configured to keep turning off the switching element Q1 in the off period Toff.

Especially, in the present embodiment, the control circuit unit 3 includes, as the input terminal 37, a first input terminal 371 used for receiving the first detection value and a second input terminal 372 used for receiving the second detection value. The circuit control unit 3 is configured to turn off the switching element Q1 when a first input value received via the first input terminal 371 exceeds the first threshold, and to turn on the switching element Q1 when a second input value received via the second input terminal 372 falls below the second threshold. In the present embodiment, the first input value is defined as a voltage (first input voltage) applied to the first input terminal 371. In the present embodiment, the second input value is defined as a voltage (second input voltage) applied to the second input terminal 372.

The next explanation is made to a circuit configuration of the control circuit unit 3. Besides, the driving circuit unit 31, the flip-flop 32, the starter 35, and the OR circuit 36 are the same as those of the lighting device 1A, and no explanations thereof are deemed necessary. The control circuit unit 3 may be constructed by use of a general-purpose PFC integrated circuit such as "MC33262" (available from ON Semiconductor) and "L6562" (available from ST Microelectronics).

The comparator 33 has a non-inverting input terminal connected to the first input terminal 371, an inverting input terminal receiving a reference voltage Vref1, and an output terminal connected to an R terminal of the flip-flop 32. The reference voltage Vref1 defines the first threshold. Upon acknowledging that the voltage (first input voltage) applied to the first input terminal 371 exceeds the reference voltage Vref1, the comparator 33 outputs an output signal having a high level from the output terminal to the R terminal of the flip-flop 32.

The zero-current detection circuit 34 is connected to the second input terminal 372. The zero-current detection circuit 34 is configured to, upon acknowledging that the voltage (second input voltage) applied the second input terminal 372 falls below the threshold voltage Vth, output a set signal constituted by a pulse wave to the OR circuit 36. The threshold voltage Vth defines the second threshold.

The dimming control unit 6 is configured to keep the first input value (first input voltage) greater than the first threshold (reference voltage Vref1) in the off period Toff. The dimming control unit 6 is configured to provide the first detection value to the first input terminal 371 of the control circuit unit 3 in the on period Ton.

The dimming control unit 6 includes a switching element Q2, a control power source E2, and a resistor R3. The resistor R3 has a first end connected to a connection point of the switching element Q1 and the resistor R1 via a resistor R2, and a second end connected to the control power source E2 via the switching element Q2. Connected to the first input terminal 371 of the control circuit unit 3 is a connection point of the resistors R2 and R3.

The dimming control unit 6 is configured to control the switching element Q2 in accordance with the dimming signal S2*a* received from the inverting element 51.

The dimming control unit 6 keeps turning on the switching element Q2 in a period in which the dimming signal S2*a* has the high level (i.e., a period [off period Toff] in which the dimming signal S2 has the low level). Consequently, a predetermined voltage (first voltage) is superimposed on (added to) the detection voltage Va. The first voltage is selected such that the first input voltage exceeds the reference voltage Vref1 irrespective of the value of the detection voltage Va. As mentioned in the above, the dimming control unit 6 keeps the first input voltage greater than the reference voltage Vref1 in the off period Toff.

The dimming control unit 6 keeps turning off the switching element Q2 in a period in which the dimming signal S2*a* has the low level (i.e., a period [on period Ton] in which the dimming signal S2 has the high level). Consequently, the detection voltage Va is inputted into the first input terminal 371 without substantial modification. In this situation, the first input voltage is equivalent to the detection voltage Va. In brief, the dimming control unit 6 supplies the first detection value to the first input terminal 371 of the control circuit unit 3 in the on period Ton.

The superimposing circuit unit 7 is configured to keep the input value not less than the second threshold in the off period Toff. The superimposing circuit unit 7 is configured to provide the detection value to the input terminal 37 of the control circuit unit 3 in the on period Ton.

In the present embodiment, the superimposing circuit unit 7 is configured to keep the second input value (second input voltage) not less than the second threshold (threshold voltage Vth) in the off period Toff. The superimposing circuit unit 7 is configured to provide the second detection value to the second input terminal 372 of the control circuit unit 3 in the on period Ton.

The superimposing circuit unit 7 is constituted by a series circuit of the resistors R4 and R5. The resistor R4 has a first end connected to the second current detection unit 42, and a second end connected to the inverting element 51 via the resistor R5. Connected to the second input terminal 372 of the control circuit unit 3 is a connection point of the resistors R4 and R5.

The superimposing circuit unit 7 is configured to add a predetermined voltage (second voltage) corresponding to a signal value (voltage) of the dimming signal S2*a* to the detection voltage Vzcd.

The superimposing circuit unit 7 is configured to superimpose the synchronization signal synchronized with the dimming signal S2 on the detection signal such that the input value (second input value) is kept not less than the second threshold (threshold voltage Vth) in the off period Toff. For example, the second voltage in the period in which the dimming signal S2*a* has the high level (i.e., the period [off period Toff] in which the dimming signal S2 has the low level) is selected such that the second input voltage exceeds the threshold voltage Vth irrespective of the value of the detection voltage Vzcd. As mentioned in the above, the superimposing circuit unit 7 keeps the second input voltage greater than the threshold voltage Vth in the off period Toff.

In contrast, the superimposing circuit unit 7 is configured to provide the detection voltage Vzcd to the zero-current detection circuit 34 in the on period Ton.

In the present embodiment, the second voltage in the period in which the dimming signal S2*a* has the low level (i.e., the period [on period Ton] in which the dimming signal S2 has the high level) is selected such that the minimum voltage of the second input voltage is less than the threshold voltage Vth.

For example, a voltage corresponding to the low level of the dimming signal S2*a* is 0 V. In this instance, the second voltage in the on period Ton is 0 V. Since the superimposing circuit unit 7 is the series circuit of the resistors R4 and R5, the second input voltage is identical to a voltage obtained by dividing the detection voltage Vzcd by the resistors R4 and R5.

In brief, the superimposing circuit unit 7 provides a value (the detection voltage Vzcd') corresponding to the second detection value (the detection voltage Vzcd) to the second input terminal 372 of the control circuit unit 3 in the on period Ton. When the voltage corresponding to the low level of the dimming signal S2*a* is 0 V, the. detection voltage Vzcd' is identical to a voltage obtained by dividing the detection voltage Vzcd by the resistors R4 and R5.

Next, a sequence of operations of the lighting device 1 of the present embodiment is explained with reference to FIG. 2 (*a*) to (*e*). Besides, no explanations are made to the same operations as those of the prior lighting device 1A.

FIG. 2 (*a*) shows the signal level of the dimming signal S2 outputted from the dimming signal generation unit 5. FIG. 2 (*b*) shows the signal level of the dimming signal S2*a* generated by means of inverting the dimming signal S2 by the inverting element 51. FIG. 2 (*c*) shows the voltage level of the detection voltage Vzcd' inputted into the zero-current detection circuit 34. FIG. 2 (*d*) shows the signal level of the driving signal S1 outputted from the driving circuit unit 31 to the switching element Q1. FIG. 2 (*e*) shows the current level of the current I1 flowing through the light source unit 10. Besides, FIG. 2 (*c*) shows the detection voltage Vzcd' which is kept between predetermined upper and lower limits by the zero-current detection circuit 34. For example, the lower limit is 0 V.

First, in the on period Ton in which the dimming signal S2 has the high level, the switching element Q2 is kept turned off. Thus, the voltage (first voltage) is not superimposed on the detection voltage Va. Further, in the on period Ton, the dimming signal S2*a* has the low level. Therefore, the voltage (second voltage) superimposed on the detection voltage Vzcd (detection voltage Vzcd') is 0. In brief, in the on period Ton, no voltages are superimposed on the respective detection voltages Va and Vzcd. The lighting device 1 operates in a similar manner as the prior lighting device 1A. Therefore, the on-off operation of the switching element Q1 is preformed.

Subsequently, when the dimming signal S2 has the low level and the sequence proceeds to the off period Toff, the switching element Q2 is switched from the off state to the on state. Therefore, the voltage (first voltage) is superimposed on (added to) the detection voltage Va. The detection voltage Va is increased by the first voltage, and the increased detection voltage Va (the sum of the original detection voltage Va and the first voltage) is greater than the reference voltage Vref1 (the first threshold). Consequently, the flip-flop 32 is switched to the reset state in a similar manner as the prior lighting device 1A, and the switching element Q1 is kept turned off.

The lighting device 1 of the present embodiment includes the superimposing circuit unit 7. Therefore, in the off period Toff in which the dimming signal S2*a* has the high level, the voltage (second voltage) is superimposed on (added to) the detection voltage Vzcd'. Thus, the detection voltage Vzcd' is increased by the second voltage, and the increased detection voltage Vzcd' (the sum of the original detection voltage Vzcd' and the second voltage) is kept greater than the threshold voltage Vth. Therefore, even when the switching element Q1 is turned off and no current flows through the inductor L1, the increased detection voltage Vzcd is not less than the threshold voltage Vth. Consequently, the zero-current detection circuit 34 outputs no set signal.

Thereafter, when the dimming signal S2 is switched to the high level and the sequence proceeds to the on period Ton again, the switching element Q2 is switched from the on state to the off state. Therefore, the voltage (first voltage) superimposed on the detection voltage Va becomes 0 V. At this time, the switching element is kept turned off, and the increased detection voltage Va is less than the reference voltage Vref1. The reset state of the flip-flop 32 is canceled.

Further, when the sequence proceeds to the on period Ton, the dimming signal S2*a* is switched to the low level and then the voltage (second voltage) superposed on the detection voltage Vzcd' becomes 0 V. Therefore, the increased detection voltage Vzcd' is decreased down to be less than the threshold voltage Vth, and then the zero-current detection circuit 34 outputs the set signal. The set signal is inputted into the S terminal of the flip-flop 32. The flip-flop 32 provides the output signal having the high level, and the switching element Q1 is switched from the off state to the on state. Thereafter, as mentioned in the above, the on-off operation of the switching element Q1 is performed.

As mentioned in the above, the lighting device 1 of the present embodiment includes the lighting circuit unit 2, the current detection unit 40, the driving circuit unit 31, and the superimposing means (superimposing circuit unit) 7. The lighting circuit unit 2 includes the series circuit of the inductor L1 and the switching element Q1, and the diode D1. The diode D1 is used for supplying energy stored in the inductor L1 to the light source unit 10 constituted by one or more light emitting elements in the off period Toff of the switching element Q1. The lighting circuit unit 2 turns on and off the switching element Q1 to supply a current from the DC power source E1 to the light source unit 10. The current detection unit 40 measures the current of the inductor L1. The driving circuit unit 31 performs the on-off operation when the dimming signal S2 having two signal states has one of the two signal states, and terminates the on-off operation to keep the switching element Q1 turned off when the dimming signal S2 has the other of the two signal states. In the on-off operation, upon acknowledging that the detection value of the current detection unit 40 exceeds the first threshold (the reference voltage Vref1), the driving circuit unit 31 switches the switching element Q1 from the on state to the off state. In the on-off operation, upon acknowledging that the detection value of the current detection unit 40 falls below the second threshold (the threshold voltage Vth), the driving circuit unit 31 switches the switching element Q1 from the off state to the on state. The superimposing means 7 superimposes the synchronization signal synchronized with the signal state of the dimming signal S2 on the detection value of the current detection unit 40. The synchronization signal has the low level less than the second threshold (the threshold voltage Vth) while the dimming signal S2 has one of the signal states, and has the high level greater than the second threshold (the threshold voltage Vth) while the dimming signal S2 has the other of the signal states.

In other words, the lighting device 1 of the present embodiment includes the switching regulator (lighting circuit unit) 2, the control circuit unit 3, the current detection unit 40, and the superimposing circuit unit 7. The switching regulator 2 includes the switching element Q1 and the inductor L1. The switching regulator 2 is configured to supply a direct current to the DC light source (light source unit) 10. The control circuit unit 3 is used for controlling the switching element Q1 in accordance with the dimming signal S2 to adjust the luminance of the DC light source 10. The current detection unit 40 is configured to output the detection value indicative of the current flowing through the inductor L1. The dimming signal S2 is defined as the signal for determining the on period in which the DC light source 10 is kept turned on and the off period in which the DC light source 10 is kept turned off. The circuit control unit 3 includes the input terminal 37 used for receiving the detection value. The circuit control unit 3 is configured to, in the on period Ton, turn off the switching element Q1 when the input value received via the input terminal 37 exceeds the first threshold (the reference voltage Vref1), and turn on the switching element Q1 when the input value falls below the second threshold (the threshold voltage Vth). The circuit control unit 3 is configured to keep turning off the switching element Q1 in the off period Toff. The superimposing circuit unit 7 is configured to keep the input value not less than the second threshold (the threshold voltage Vth) in the off period Toff.

Further, in the lighting device 1 of the present embodiment, the superimposing circuit unit 7 is configured to provide the detection value to the input terminal 37 of the control circuit unit 3 in the on period Ton.

Further, in the lighting device 1 of the present embodiment, the current detection unit 40 is configured to output the detection signal having the signal value corresponding to the detection value. The superimposing circuit unit 7 is configured to superimpose the synchronization signal synchronized with the dimming signal S2 on the detection signal such that the input value is kept not less than the second threshold in the off period Toff.

Further, the lighting device 1 of the present embodiment further includes the dimming control circuit 6. The current detection unit 40 is configured to output, as the detection value, the first detection value corresponding to the current flowing through the inductor L1 while the switching element Q1 is turned on, and the second detection value corresponding to the current flowing through the inductor L1 while the switching element Q1 is turned off. The control circuit unit 3 includes, as the input terminal 37, the first input terminal 371 used for receiving the first detection value and the second input terminal 372 used for receiving the second detection value. The circuit control unit 3 is configured to turn off the switching element Q1 when the first input value received via the first input terminal 371 exceeds the first threshold (the reference voltage Vref1), and to turn on the switching element Q1 when the second input value received via the second input terminal 372 falls below the second threshold (the threshold voltage Vth). The dimming control circuit 6 is configured to keep the first input value greater than the first threshold (the reference voltage Vref1) in the off period Toff. The superimposing circuit unit 7 is configured to keep the second input value not less than the second threshold (the threshold voltage Vth) in the off period Toff.

Further, in the lighting device 1 of the present embodiment, the dimming control unit 6 is configured to provide the first detection value to the first input terminal 371 of the control circuit unit 3 in the on period Ton. The superimposing circuit unit 7 is configured to provide the second detection value to the second input terminal 372 of the control circuit unit 3 in the on period Ton.

Further, in the lighting device 1 of the present embodiment, the current detection unit 40 is provided as the set of the first current detection unit 41 for obtaining the first detection value and the second current detection unit 42 for obtaining the second detection value. The first current detection unit 41 is constituted by the resistor R1 connected in series with the switching element Q1. The second current detection unit 42 is constituted by the second inductor (secondary winding) n2 magnetically connected to the inductor L1.

As mentioned in the above, according to the present embodiment, in the off period Toff in which the on-off operation of the switching element Q1 is not performed, the voltage (second voltage) is superimposed on the detection voltage Vzcd' inputted into the zero-current detection circuit 34 so as to forcibly keep the increased detection voltage Vzcd' equal to or more than the threshold voltage Vth.

Subsequently, when the sequence proceeds from the off period Toff to the on period again and the superimposed voltage (second voltage) becomes 0 V, the increased detection voltage Vzcd' falls below the threshold voltage Vth. As a result, the set signal is outputted from the zero-current detection circuit 34 and the on-off operation of the switching element Q1 is restarted.

Further, the voltage (second voltage) superimposed on the detection voltage Vzcd' is varied synchronized with the signal level of the dimming signal S2. Therefore, when the sequence proceeds from the on period Ton to the off period Toff, the reset state of the flip-flop 32 is canceled and the set signal is outputted from the zero-current detection circuit 34. Consequently, when the sequence proceeds to the on period Ton, the on-off operation of the switching element Q1 can be restarted immediately.

Further, according to present embodiment, the starter 35 is not used in order to restart the on-off operation of the switching element Q1. Consequently, the dimming control can be performed even when the off period Toff is shorter than the starting period Tstr.

In other words, the lighting device 1 of the present embodiment can extend the dimming range of the burst dimming control. Specifically, the lighting device 1 of the present embodiment can perform the burst dimming control of varying the dimming level of the light source unit 10 from 0 to 100%.

Further, the lighting device 1 of the present embodiment operates without problems even when it includes the starter 35. Therefore, a general-purpose integrated circuit can be adopted as the control circuit unit 3. It is possible to reduce production cost.

Further, in the lighting device 1 of the present embodiment, the lighting circuit unit 2 is constituted by a step-down chopper circuit including the inductor L1 and the switching element Q1 which constitute a series circuit with the light source unit 10.

In other words, the lighting circuit unit (switching regulator) 2 is configured to store energy from the power source (DC power source) E1 in the inductor L1 while the switching element Q1 is turned on, and supply energy stored in the inductor L1 to the DC light source (light source unit) 10 while the switching element Q1 is turned off. Especially, in the lighting device 1 of the present embodiment, the switching regulator 2 is constituted by a step-down chopper circuit.

In the present embodiment, the DC power source E1 is used as an input power source. However, an AC power source may be used as the input power source, and a DC power source may be constituted by an AC/DC converter designed to convert an AC voltage from the AC power source to a desired DC voltage and output the resultant DC voltage. Alternatively, the DC power source may be constituted by the DC power source E1 and a DC/DC converter designed to convert the DC voltage from the DC power source E1 to a desired DC voltage and output the resultant DC voltage.

In brief, in the present lighting device 1, the DC power source E1 may be constituted by an AC/DC converter designed to convert an AC voltage to a desired DC voltage and output the resultant DC voltage or a DC/DC converter designed to convert a DC voltage to a desired DC voltage and output the resultant DC voltage.

In other words, the lighting device 1 of the present embodiment may include a DC power generation unit. The switching regulator 2 is configured to supply a direct current to the DC light source 10 by use of DC power from the DC power generation unit. The DC power generation unit is constituted by an AC/DC converter or a DC/DC converter.

In any case, the aforementioned effect can be obtained.

Further, in the present embodiment, the switching element Q1 is positioned on the low voltage side of the DC power source E1. However, the lighting circuit unit 2 may have the switching element Q1 positioned on the high voltage side of the DC power source E1. The lighting circuit unit 2 is not limited to a step-down chopper circuit, but may be a boost chopper or a buck-boost chopper.

Second Embodiment

Figure 3:
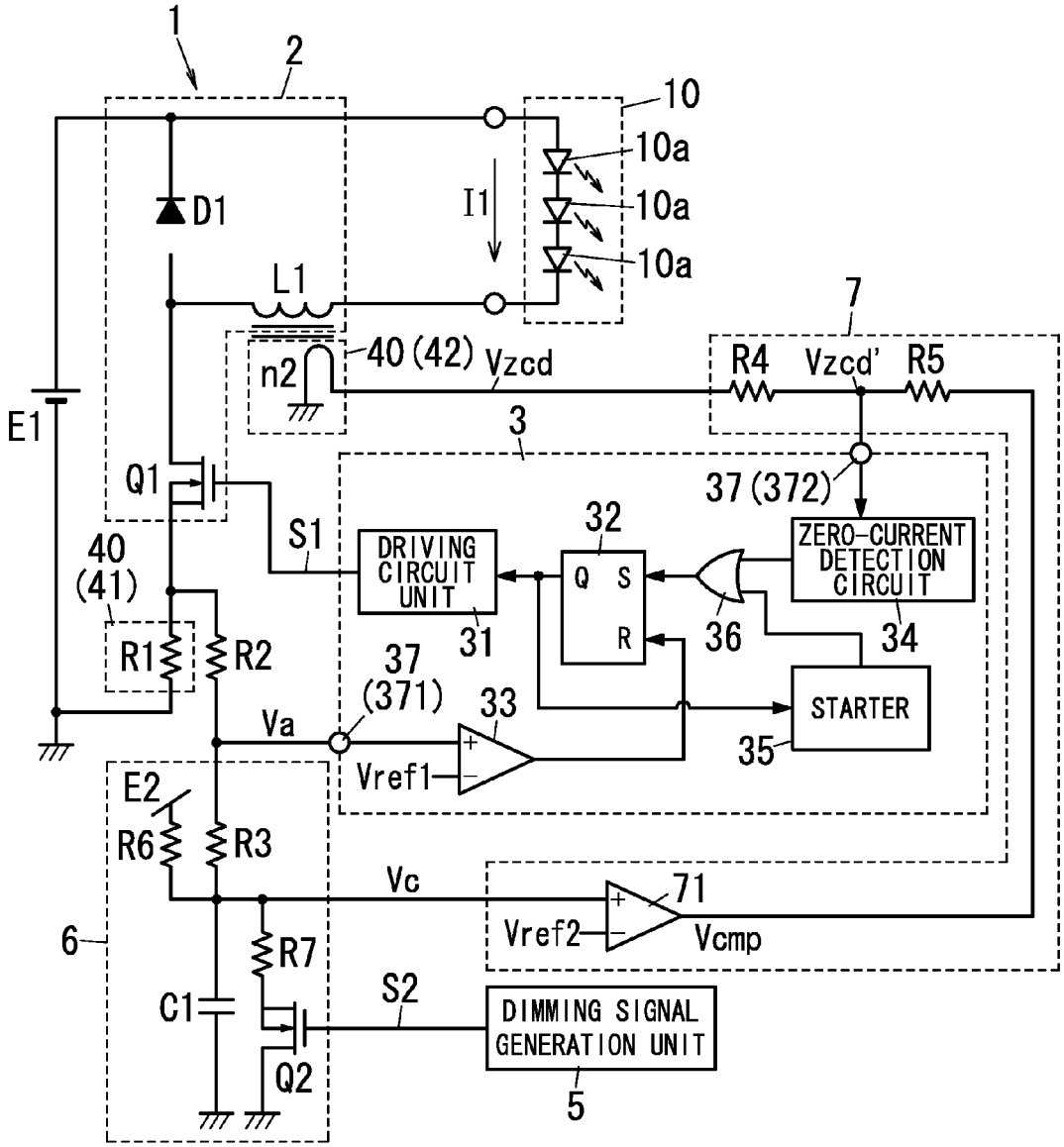
FIG. 3 is a circuit configuration diagram illustrating the lighting device 1 of the second embodiment.

FIG. 3 shows a circuit configuration diagram of the lighting device 1 of the present embodiment. Besides, the same components of the present embodiment as the first embodiment are designated by the same reference numerals and no explanations thereof are deemed necessary.

The dimming control unit 6 of the present embodiment is constituted by the control power source E2, resistors R3, R6, and R7, a capacitor C1, and the switching element Q2. The control power source E2, the resistor R6, and the capacitor C1 are connected in series with each other. Connected in parallel with the capacitor C1 is a series circuit of the resistor R7 and the switching element Q2. The resistor R3 is connected in series with the capacitor C1. The comparator 33 has the non-inverting input terminal connected to a connection point of the resistors R2 and R3 via the first input terminal 371. Further, the switching element Q2 is an n-channel MOSFET and has a gate connected to the dimming signal generation unit 5 to receive the dimming signal S2.

The dimming control unit 6 of the present embodiment controls the switching element Q2 in accordance with the dimming signal S2 received from the dimming signal generation unit 5.

The dimming control unit 6 keeps turning off the switching element Q2 in the period (off period Toff) in which the dimming signal S2 has the low level. Consequently, the capacitor C1 is charged with electricity from the control power source E2. As a result, the predetermined voltage (first voltage) is added to the detection voltage Va. Thus, in the off period Toff, the input voltage is the sum of the detection voltage Va and the first voltage. The first voltage is selected such that the first input voltage exceeds the reference voltage Vref1 irrespective of the value of the detection voltage Va. The first voltage is determined by a voltage (capacitor voltage) Vc between opposite ends of the capacitor C1 and the resistor R3. As mentioned in the above, the dimming control unit 6 keeps the first input voltage greater than the reference voltage Vref1 in the off period Toff.

The dimming control unit 6 keeps turning on the switching element Q2 in the period (on period Ton) in which the dimming signal S2 has the high level. Therefore, the capacitor C1 is discharged. Consequently, the detection voltage Va is inputted into the first input terminal 371 without substantial modification. In this situation, the first input voltage is equivalent to the detection voltage Va. In brief, the dimming control unit 6 supplies the first detection value to the first input terminal 371 of the control circuit unit 3 in the on period Ton.

To realize the burst dimming control of intermittently performing the on-off operation of the switching element Q1, the dimming control unit 6 of the present embodiment superimposes the voltage (first voltage) on the detection voltage Va by use of the charging voltage of the capacitance C1.

The superimposing circuit unit 7 of the present embodiment is constituted by the resistors R4 and R5 and a comparator 71. The comparator 71 has a non-inverting input terminal connected to the capacitor C1 to receive the capacitor voltage Vc at the non-inverting input terminal, and an inverting input terminal receiving the reference voltage Vref2. The comparator 71 outputs an output voltage Vcmp, and the output voltage Vcmp is divided by the resistors R4 and R5 and the resultant voltage are inputted into the zero-current detection circuit 34. Besides, when the output voltage Vcmp of the comparator 71 has a high level, a voltage superimposed on the detection voltage Vzcd' is selected to be equal to or more than the threshold voltage Vth. In contrast, when the output voltage Vcmp has a low level, a voltage superimposed on the detection voltage Vzcd' is selected to be zero (i.e., less than the threshold voltage Vth). Note that a voltage signal obtained by dividing the output voltage Vcmp by the resistors R4 and R5 is corresponding to the synchronization signal.

As mentioned in the above, the superimposing circuit unit 7 of the present embodiment includes the series circuit of the resistors R4 and R5 and the comparator 71. The resistor R4 has one end connected to the second current detection unit 42 and the other end connected to the output terminal of the comparator 71 through the resistor R5. The second input terminal 372 of the control circuit unit 3 is connected to the connection point of the resistors R4 and R5.

The comparator 71 has the non-inverting input terminal connected to a connection point of the capacitor C1 and the resistor R3, and the inverting input terminal receiving the reference voltage Vref2. Consequently, the capacitor voltage Vc is applied to the non-inverting input terminal of the capacitor 71.

When the capacitor voltage Vc is greater than the reference voltage Vref2, the comparator 71 outputs the output signal (output voltage Vcmp) having the high level from the output terminal. When the capacitor voltage Vc is not greater than the reference voltage Vref2, the comparator 71 outputs the output signal (output voltage Vcmp) having the low level from the output terminal. The reference voltage Vref2 is selected to be less than the capacitor voltage Vc obtained when the dimming signal S2 has the low level.

Therefore, the superimposing circuit unit 7 adds a predetermined voltage (second voltage) corresponding to the signal value (the output voltage Vcmp) of the output signal of the comparator 71 to the detection voltage Vzcd. In brief, the superimposing circuit unit 7 is configured to superimpose the synchronization signal (the output signal of the comparator 71) synchronized with the dimming signal S2 on the detection signal such that the input value (second input value) is not less than the second threshold (threshold voltage Vth) in the off period Toff.

The second voltage in the period (off period Toff) in which the dimming signal S2 has the low level is selected such that the second input voltage exceeds the threshold voltage Vth irrespective of the value of the detection voltage Vzcd. In brief, the high level output voltage Vcmp of the comparator 71 is selected to produce the second voltage making the second input voltage exceed the threshold voltage Vth irrespective of the value of the detection voltage Vzcd. As mentioned in the above, the superimposing circuit unit 7 keeps the second input voltage greater than the threshold voltage Vth in the off period Toff.

The second voltage in the period (on period Ton) in which the dimming signal S2 has the high level is selected such that the minimum voltage of the second input voltage is less than the threshold voltage Vth.

For example, a voltage corresponding to the low level of the output voltage Vcmp of the comparator 71 is 0 V. In this instance, the second voltage in the on period Ton is 0 V. Since the superimposing circuit unit 7 includes the series circuit of the resistors R4 and R5, the second input voltage is identical to a voltage obtained by dividing the detection voltage Vzcd by the resistors R4 and R5.

In brief, the superimposing circuit unit 7 provides a value (the detection voltage Vzcd') corresponding to the second detection value (the detection voltage Vzcd) to the second input terminal 372 of the control circuit unit 3 in the on period Ton. When the voltage corresponding to the low level of the output voltage Vcmp of the comparator 71 is 0 V, the. detection voltage Vzcd' is identical to a voltage obtained by dividing the detection voltage Vzcd by the resistors R4 and R5.

Figure 4:
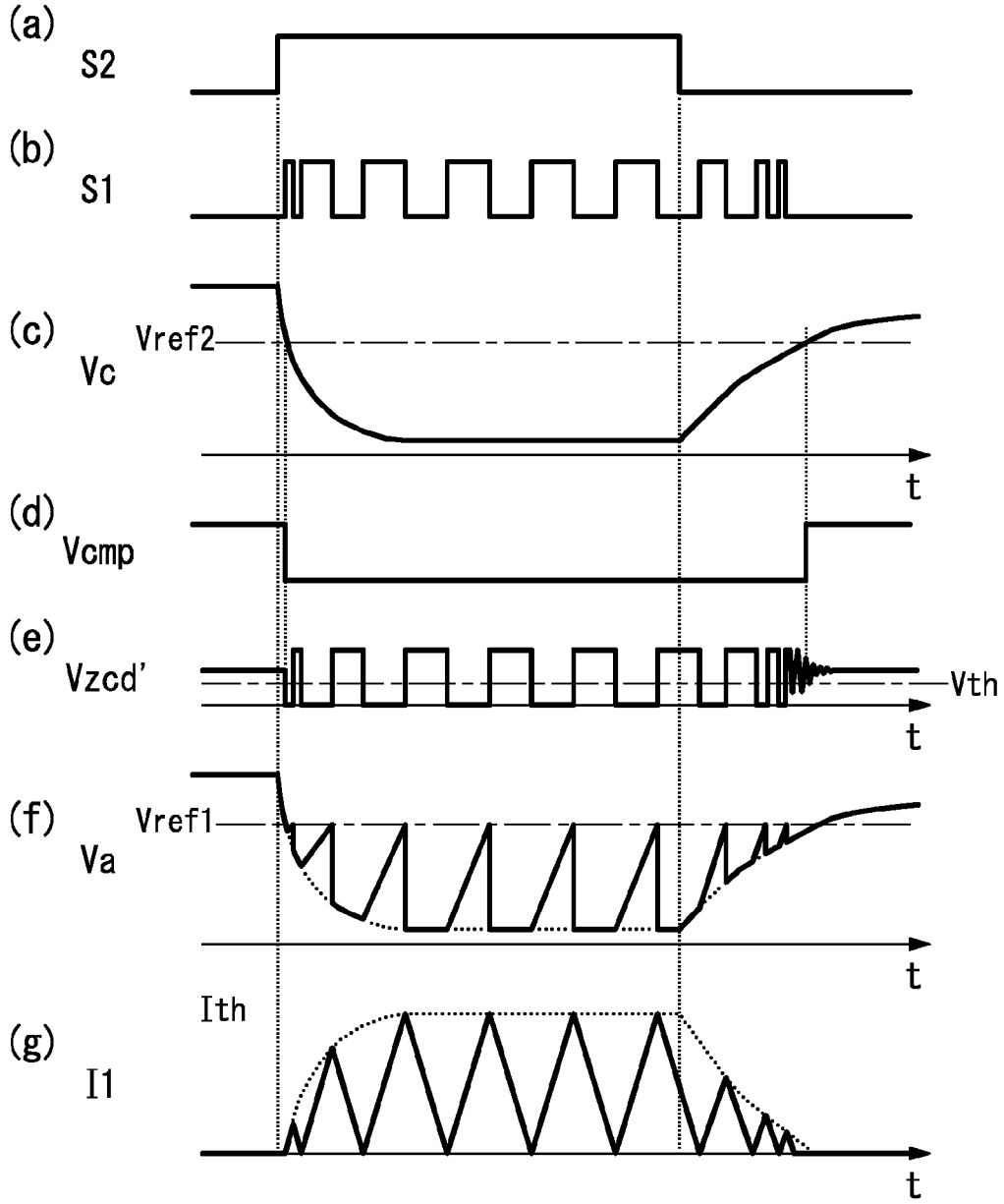
FIG. 4 shows a timing chart (a) illustrating the dimming signal S2, a timing chart (b) illustrating the dimming signal S2*a*, a timing chart (c) illustrating the capacitor voltage Vc, a timing chart (d) illustrating the output voltage Vcmp, a timing chart (e) illustrating the detection voltage Vzcd', a timing chart (f) illustrating the detection voltage Va, and a timing chart (g) illustrating the current I1.

Next, a sequence of operations of the lighting device 1 of the present embodiment is explained with reference to FIG. 4 (*a*) to (*g*).

First, when the dimming signal S2 is changed from the low level to the high level and the sequence proceeds to the on period Ton, the switching element Q2 is turned on and then the capacitor C1 is discharged. Thereby, the capacitor voltage Vc is lowered. As a result, the voltage (first voltage) superimposed on the detection voltage Va is reduced. When the detection voltage Va falls below the reference voltage Vref1, the reset state of the flip-flop 32 is canceled (see FIGS. 4 (*c*) and (*f*)).

Subsequently, when the capacitor voltage Vc falls below the reference voltage Vref2, the output voltage Vcmp of the comparator 71 is changed from the high level to the low level (see FIG. 4 (*d*)). Consequently, the voltage superimposed on the detection voltage Vzcd' becomes zero, and the set signal is outputted from the zero-current detection circuit 34. The on-off operation of the switching element Q1 is restarted.

In this time, since the capacitor C1 and the resistor R7 constitute an integrating circuit, the capacitor voltage Vc of the capacitor C1 is decreased exponentially. Thus, the voltage (first voltage) superimposed on the detection voltage Va is also reduced exponentially. Consequently, a peak value Ith of the current I1 is increased exponentially (see FIG. 4 (*g*).

Next, when the dimming signal S2 is changed from the high level to the low level and the sequence proceeds to the off period Toff, the switching element Q2 is turned off and then the capacitor C1 is charged. Thereby, the capacitor voltage Vc is raised. In this time, since the capacitor C1 and the resistor R6 constitute an integrating circuit, the capacitor voltage Vc is increased exponentially (see FIG. 4 (*c*)). Thus, the voltage superimposed on the detection voltage Va is also raised exponentially. Consequently, the peak value Ith of the current I1 is decreased exponentially (see FIGS. 4 (*g*) and (*g*).

Subsequently, when the detection voltage Va is not less than the reference voltage Vref1, the flip-flop 32 is switched to the reset state, and the switching element Q1 is kept turned off. Further, when the capacitor voltage Vc is not less than the reference voltage Vref2, the output voltage Vcmp of the comparator 71 is changed to the high level, and then the voltage (second voltage) is superimposed on the detection voltage Vzcd'. As result, the increased (resultant) detection voltage Vzcd' (the sum of the original detection voltage Vzcd' and the second voltage) is kept not less than the threshold voltage Vth.

As mentioned in the above, the lighting device 1 of the present embodiment varies gradually the voltage (first voltage) superimposed on the detection voltage Va in a transition period between the on period Ton and the off period Toff. Consequently, it is possible to smoothly vary the light output in response to a continuous change in the on-duty level (duty ratio) of the dimming signal S2.

Further, the voltage (second voltage) is superimposed on the detection voltage Vzcd' such that the resultant (increased) detection voltage Vzcd' is kept not less than the threshold Vth in the off period Toff in a similar manner as the first embodiment. Consequently, it is possible to restart the on-off operation of the switching element Q1 in response to the start of the on period Ton. Thus, the burst dimming control of varying the dimming level from 0% to 100% of the light power source 10 can be implemented. Besides, the timings for termination and restart of the on-off operation of the switching element Q1 can be adjusted by selecting the reference voltages Vref1 and Vref2 and the capacitance of the capacitor C1, for example.

Figure 5:
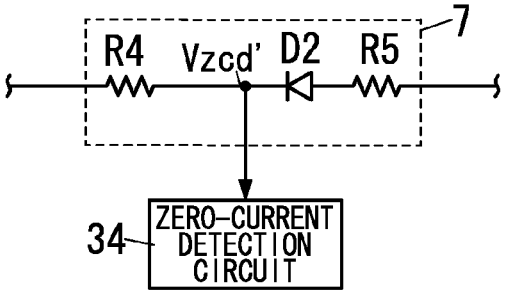
FIG. 5 is a circuit diagram illustrating another configuration of the superimposing circuit unit 7.

In addition, with regard to the first and second embodiments, as shown in FIG. 5, the superimposing circuit unit 7 includes a diode D2 interposed between the resistors R4 and R5, and is configured to superimpose the voltage (second voltage) on the detection voltage Vzcd' via the resistor R5 and the diode D2.

With this arrangement, it is possible to prevent a flow of a current through the resistor R5 in the on period Ton in which the superimposed voltage (second voltage) is zero. Further, the voltage (second voltage) can be superimposed on the detection voltage Vzcd' only in the off period Toff. Therefore, the effect caused by the resistor R5 on the detection voltage Vzcd can be eliminated. Consequently, since the detection voltage Vzcd' is substantially equivalent to the detection voltage Vzcd of the prior lighting device 1A, a configuration similar to the prior configuration can be adopted and thus flexibility of a design can be improved.

Alternatively, with regard to the OFF period Toff, the superimposing circuit unit 7 may apply a voltage greater than the threshold voltage Vth to the second input terminal instead of superimposing the second voltage on the detection voltage Vzcd'. In brief, it is sufficient that the superimposing circuit unit 7 is configured to keep the input value (second input value) not less than the second threshold in the off period Toff.

Third Embodiment

Figure 6:
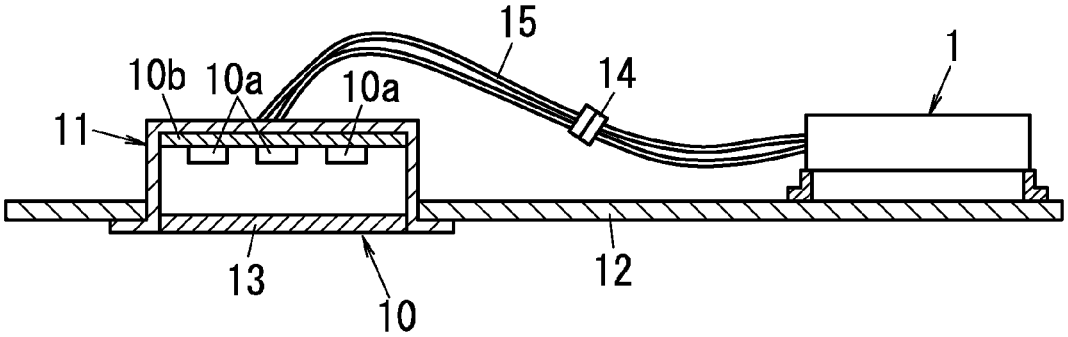
FIG. 6 is a schematic configuration diagram illustrating a lighting fixture used with a separated power source.
Figure 7:
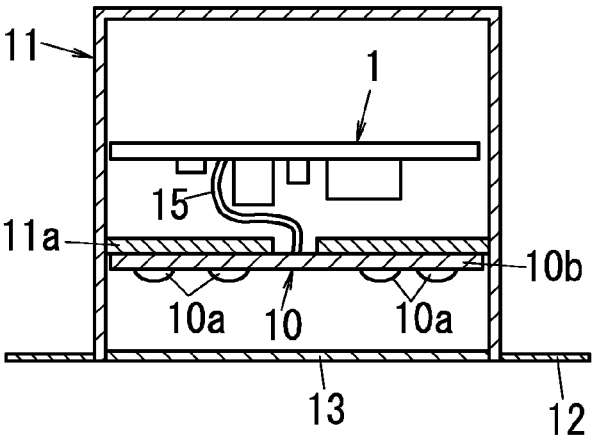
FIG. 7 is a schematic configuration diagram illustrating a lighting fixture used with an integrated power source.
Figure 8:
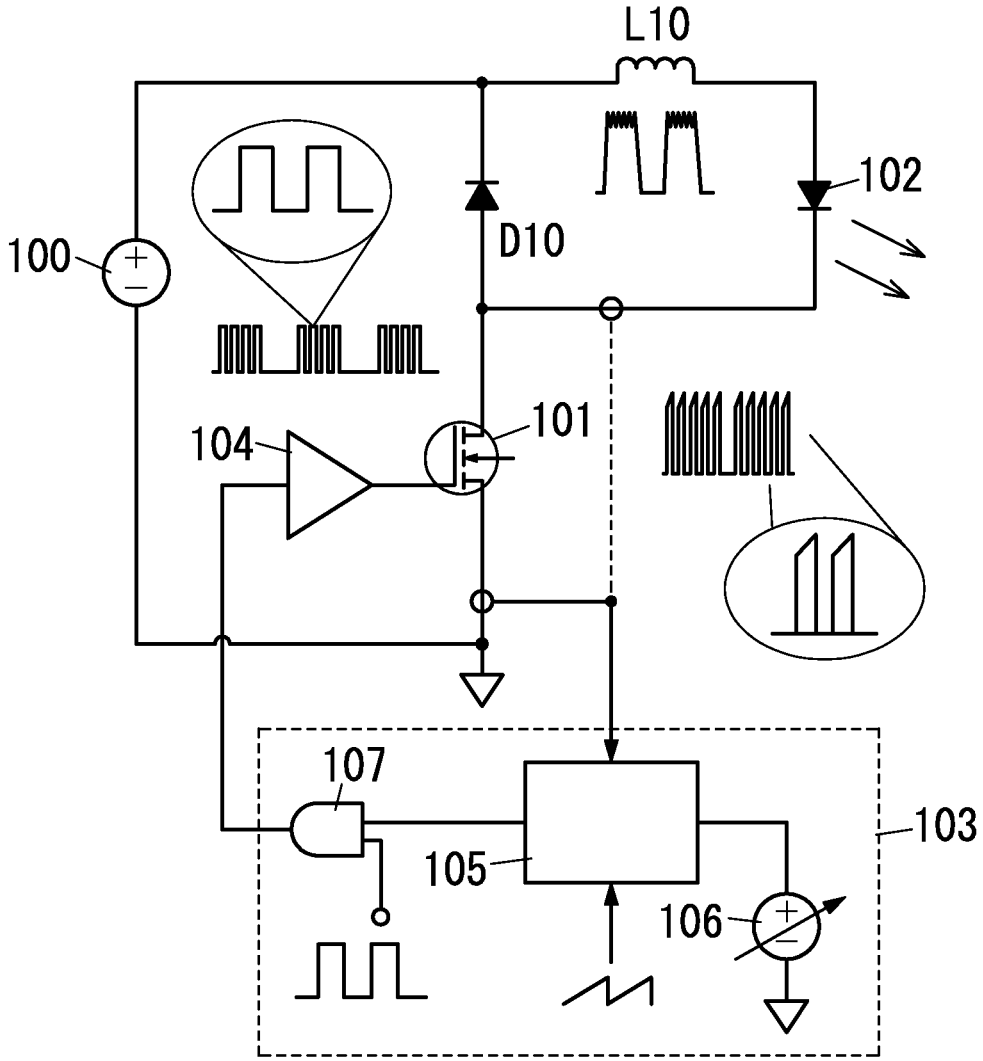
FIG. 8 is a circuit configuration diagram illustrating a prior lighting device.

Each of FIG. 6 and FIG. 7 shows a schematic diagram of the lighting fixture of the present embodiment. In the following explanation, upward directions and downward directions of the lighting fixtures are corresponding to upward directions and downward directions in FIG. 6 and FIG. 7, respectively.

The lighting device 1 of the first or second embodiment is used as the lighting device 1 in the present embodiment.

As shown in FIG. 6, the lighting fixture of the present embodiment is a separate type lighting fixture in which a set of the DC power source and the lighting fixture 1 and the light source unit 10 are provided as separate units. There is a fixture body 11 which is configured to house the light source unit 10 is embedded in a ceiling 12.

The fixture body 11 is a metal product (e.g., an aluminum die-cast product), for example. The fixture body 11 is shaped into a hollow cylinder having an opened lower surface, for example. The light source unit 10 is positioned on an internal upper bottom of the fixture body 11. The light source unit 10 includes plural (three in the illustrated instance) light emitting diodes 10*a* and a substrate 10*b* on which the plural light emitting diodes 10*a* are mounted. Besides, to emit light to an external space via the opening formed in the lower surface of the fixture body 11, the plural light emitting diodes 10*a* are arranged to have light emission directions oriented downward.

Further, provided to cover the opening formed in the lower surface of the fixture body 11 is a transparent plate 13. The transparent plate 13 is configured to diffuse light from the light emitting diode 10*a*. The lighting device 1 and the fixture body 11 are placed on different sites in a rear surface (upper surface) of the ceiling 12. The lighting device 1 and the light source unit 10 are connected by use of lead cables 15 and connectors 14.

As mentioned in the above, the lighting fixture of the present embodiment includes the lighting device 1 of the first or second embodiment, the light source unit 10, and the fixture body 11. The light source unit 10 is constituted by one or more light emitting elements. The light source unit 10 is lit by the lighting device 1. The fixture body 11 is configured to accommodate the lighting device 1 and the light source unit 10.

In other words, the lighting fixture of the present embodiment includes the lighting device 1 defined by the first or second embodiment, and the fixture body 11 configured to accommodate the lighting device 1.

As mentioned in the above, the lighting fixture of the present embodiment employs the lighting device 1 of the first or second embodiment. Therefore, the lighting fixture of the present embodiment can produce the same effect as the first or second embodiment.

Alternatively, as shown in FIG. 7, the lighting fixture of the present embodiment may be designed as an integration type lighting fixture in which the lighting fixture 1 and the light source unit 10 are accommodated in the fixture body 11.

In this configuration, there is a heat radiation plate 11*a* which is placed on the substrate 10*b* in contact with the fixture body 11. The heat radiation plate 11*a* is made of an aluminum plate or a copper plate, for example. With this configuration, it is possible to transfer heat generated at the plural light emitting diodes 10*a* to an outside via the heat radiation plate 11*a* and the fixture body 11.

The invention claimed is:

1. A lighting device comprising:

a switching regulator including a switching element and an inductor and configured to supply a direct current to a DC light source;

a control circuit unit for controlling said switching element in accordance with a dimming signal to adjust luminance of the DC light source;

a current detection unit configured to output a detection value indicative of a current flowing through said inductor; and a superimposing circuit unit, wherein the dimming signal is defined as a signal for determining an on period in which the DC light source is kept turned on and an off period in which the DC light source is kept turned off, and said circuit control unit includes an input terminal used for receiving the detection value, and said circuit control unit is configured to, in the on period, turn off said switching element when an input value received via said input terminal exceeds a first threshold, and turn on said switching element when the input value falls below a second threshold, and said circuit control unit is configured to keep turning off said switching element in the off period, and said superimposing circuit unit is configured to keep the input value not less than the second threshold in the off period.

2. A lighting device as set forth in claim 1, wherein said superimposing circuit unit is configured to provide the detection value to said input terminal of said control circuit unit in the on period.

3. A lighting device as set forth in claim 2, wherein said current detection unit is configured to output a detection signal having a signal value corresponding to the detection value, and said superimposing circuit unit is configured to superimpose a synchronization signal synchronized with the dimming signal on the detection signal such that the input value is kept not less than the second threshold in the off period.

4. A lighting device as set forth in claim 1, wherein said current detection unit is configured to output a detection signal having a signal value corresponding to the detection value, and said superimposing circuit unit is configured to superimpose a synchronization signal synchronized with the dimming signal on the detection signal such that the input value is kept not less than the second threshold in the off period.

5. A lighting device as set forth in claim 1, wherein said lighting device further comprises a dimming control circuit, and said current detection unit is configured to output, as the detection value, a first detection value corresponding to a current flowing through said inductor while said switching element is turned on, and a second detection value corresponding to a current flowing through said inductor while said switching element is turned off, and said control circuit unit includes, as said input terminal, a first input terminal used for receiving the first detection value and a second input terminal used for receiving the second detection value, and said circuit control unit is configured to turn off said switching element when a first input value received via said first input terminal exceeds the first threshold, and to turn on said switching element when a second input value received via said second input terminal falls below the second threshold, and said dimming control circuit is configured to keep the first input value greater than the first threshold in the off period, and said superimposing circuit unit is configured to keep the second input value not less than the second threshold in the off period.

6. A lighting device as set forth in claim 5, wherein said dimming control unit is configured to provide the first detection value to said first input terminal of said control circuit unit in the on period, and said superimposing circuit unit is configured to provide the second detection value to said second input terminal of said control circuit unit in the on period.

7. A lighting device as set forth in claim 5, wherein said current detection unit is provided as a set of a first current detection unit for obtaining the first detection value and a second current detection unit for obtaining the second detection value, and said first current detection unit is constituted by a resistor connected in series with said switching element, and said second current detection unit is constituted by a second inductor magnetically connected to said inductor.

8. A lighting device as set forth in claim 1, wherein said dimming signal has a second signal value, and said dimming signal has a first period in which the second signal value exceeds a predetermined value and a second period in which the second signal falls below the predetermined value, and one of the first period and the second period defines the on period and the other of the first period and the second period defines the off period.

9. A lighting device as set forth in claim 1, wherein said switching regulator is configured to store energy from a power source in said inductor while said switching element is turned on, and supply energy stored in said inductor to the DC light source while said switching element is turned off.

10. A lighting device as set forth in claim 9, wherein said switching regulator is constituted by a step-down chopper circuit.

11. A lighting device as set forth in claim 1, wherein said lighting device further comprises a DC power generation unit, and said switching regulator is configured to supply a direct current to the DC light source by use of DC power from said DC power generation unit, and said DC power generation unit is constituted by an AC/DC converter or a DC/DC converter.

12. A lighting fixture comprising:

a lighting device defined by claim 1; and a fixture body configured to accommodate said lighting device.

* * * * *